US008740408B2

(12) United States Patent
Yoon et al.

(10) Patent No.: US 8,740,408 B2
(45) Date of Patent: Jun. 3, 2014

(54) LIGHT EMITTING DIODE (LED) MODULE

(75) Inventors: Sang Ho Yoon, Yongin-si (KR); Hyung Jin Kim, Seoul (KR)

(73) Assignee: Samsung Electronics Co., Ltd., Seoul (KR)

( * ) Notice: Subject to any disclaimer, the term of this patent is extended or adjusted under 35 U.S.C. 154(b) by 167 days.

(21) Appl. No.: 13/408,262

(22) Filed: Feb. 29, 2012

(65) Prior Publication Data

US 2012/0230033 A1 Sep. 13, 2012

(30) Foreign Application Priority Data

Mar. 8, 2011 (KR) ..... 10-2011-0020433

(51) Int. Cl.
*F21V 1/00* (2006.01)
*F21K 99/00* (2010.01)

(52) U.S. Cl.
CPC ..... *F21K 9/00* (2013.01)
USPC ..... 362/249.01; 362/294; 362/267; 362/326

(58) Field of Classification Search
USPC ..... 362/249.01, 249.02, 294, 373, 267, 362/234; 257/722; 174/252
See application file for complete search history.

(56) References Cited

U.S. PATENT DOCUMENTS

| | | | | |
|---|---|---|---|---|
| 4,845,600 | A | 7/1989 | Matsumura et al. | |
| 7,661,854 | B1 * | 2/2010 | Yang et al. | 362/373 |
| 7,887,218 | B2 * | 2/2011 | Wang | 362/240 |
| 8,007,131 | B2 * | 8/2011 | Liu et al. | 362/267 |
| 8,123,380 | B2 * | 2/2012 | Liao | 362/267 |
| 2002/0121390 | A1 * | 9/2002 | Alznauer et al. | 174/152 R |
| 2007/0177401 | A1 | 8/2007 | Nakabayashi | |
| 2009/0310363 | A1 | 12/2009 | Liu et al. | |
| 2010/0295071 | A1 | 11/2010 | Tsai et al. | |

FOREIGN PATENT DOCUMENTS

| | | | |
|---|---|---|---|
| CN | WO2010022625 | * | 3/2010 |
| CN | 101776256 | A | 7/2010 |
| CN | 201547954 | U | 8/2010 |
| EP | 2 157 369 | A1 | 2/2010 |
| EP | 2 400 206 | A1 | 12/2011 |
| KR | 10-2009-0077100 | A | 7/2009 |
| KR | 10-1011823 | B1 | 2/2011 |
| WO | 2010/095424 | A1 | 8/2010 |

OTHER PUBLICATIONS

Extended European Search Report issued in European Patent Application No. EP 12158152.4 dated Mar. 15, 2013.
European Examination Report issued in European Patent Application No. EP 12 158 152.4 dated Dec. 18, 2013.

* cited by examiner

*Primary Examiner* — Ali Alavi
(74) *Attorney, Agent, or Firm* — McDermott Will & Emery LLP

(57) ABSTRACT

A light emitting diode (LED) module is provided. The LED module includes a substrate on which an LED is mounted; a heat radiation unit configured to include an insertion hole for passage of a power supply cable that supplies power to the substrate; a lens plate configured to include a lens corresponding to the LED and to cover the substrate; a rubber seal configured to be disposed between the heat radiation unit and the lens plate; and a waterproof structure configured to be inserted in the insertion hole and to include a through hole to receive the power supply cable, wherein the substrate is received in an inner space constructed as the lens plate, the rubber seal, and the heat radiation unit are connected, and the inner space has a waterproof structure.

7 Claims, 5 Drawing Sheets

LIGHT EMITTING DIODE (LED) MODULE

CROSS-REFERENCE TO RELATED APPLICATION

This application claims the benefit of Korean Patent Application No. 10-2011-0020433, filed on Mar. 8, 2011, in the Korean Intellectual Property Office, the disclosure of which is incorporated herein by reference.

BACKGROUND

1. Field

Example embodiments of the following description relate to a light emitting diode (LED) module capable of maintaining waterproof integrity separately from a lighting device, and more particularly, to an LED module capable of improving a waterproof function by altering a structure thereof to independently maintain waterproof integrity without altering a structure of the lighting device.

2. Description of the Related Art

In general, a street light refers to a lighting device installed along a street for safety and security of road traffic. Various types of the street lights are properly applied according to installation areas such as a highway, a general road, a sidewalk, a residential street, and the like. Recently, street lights or lighting devices employing a high-brightness light emitting diode (LED) as a light source are used more and more in consideration of power consumption, lifespan of a bulb, brightness, and a light diffusion range.

Since the lighting device using the high-brightness LED has many structural differences from a lighting device using a conventional light source, a dustproof and waterproof structure needs to be added.

Especially, it is an essential technology to secure a waterproof function along with a heat radiation function in a structure where a plurality of regularly arranged LEDs are attached to a conventional lighting device.

In general, it is structurally difficult to mount an engine radiation type LED module, which has a self heat radiation structure, to a conventional lighting device without alteration of the structure, due to existence of heat radiation fins. In addition, when the LED module is a lighting device heat radiation type which employs a heat radiation structure of the lighting device, it is difficult to mount a thin LED module to the conventional lighting device due to existence of a power supply cable connected to the LED module. Accordingly, there is a need for an LED module capable of independently maintaining a waterproof function.

SUMMARY

According to example embodiments, there may be provided a light emitting diode (LED) module achieving dustproof and waterproof functions by itself through alteration of the structure, without alteration of a structure of a lighting device to which the LED module is mounted.

According to example embodiments, there may also be provided an LED module being easily mounted to a lighting device of a lighting device heat radiation type, by varying a power supply structure that supplies power to a substrate.

The foregoing and/or other aspects are achieved by providing an LED module including a substrate on which an LED is mounted; a heat radiation unit configured to include an insertion hole for passage of a cable that supplies power to the substrate; a lens plate configured to include a lens corresponding to the LED and to cover the substrate; a rubber seal configured to be disposed between the heat radiation unit and the lens plate; and a waterproof structure configured to be inserted in the insertion hole and to include a through hole to receive the cable, wherein the substrate is received in an inner space constructed as the lens plate, the rubber seal, and the heat radiation unit are connected, and the inner space has a waterproof structure.

The insertion hole may have at least one of a shape gradually widening toward the inner space, and a shape of which a portion adjoining the inner space has a larger cross-section than a portion not adjoining the inner space.

The waterproof structure may be made of an elastic material.

The waterproof structure may have a shape of which a cross-section increases toward the inner space or a shape of which a portion received in the inner space has a larger cross-section than a portion received in the heat radiation unit.

A portion of the waterproof structure may be compressed by the substrate when the substrate is connected with the heat radiation unit.

The heat radiation unit may be in the form of an aluminum plate.

Additional aspects, features, and/or advantages of example embodiments will be set forth in part in the description which follows and, in part, will be apparent from the description, or may be learned by practice of the disclosure.

Effect

According to the embodiments, an LED module may have a waterproof function by itself regardless of a structure of a lighting device. Therefore, entry of moisture and foreign substances may be prevented.

According to the embodiments, since a power supply cable connected to the LED module is inserted in the LED module, a separate external structure, such as a cable grand, to connect the LED module with the cable may be omitted. Consequently, the LED module may become more compact and be easily mounted to a conventional lighting device.

Also, since an inner space of a through hole is reduced by shapes of an insertion hole and an altered waterproof structure and by compression by a circuit board, the power supply cable may be prevented from escaping the through hole. Also, the waterproof integrity of the inner space may be maintained.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
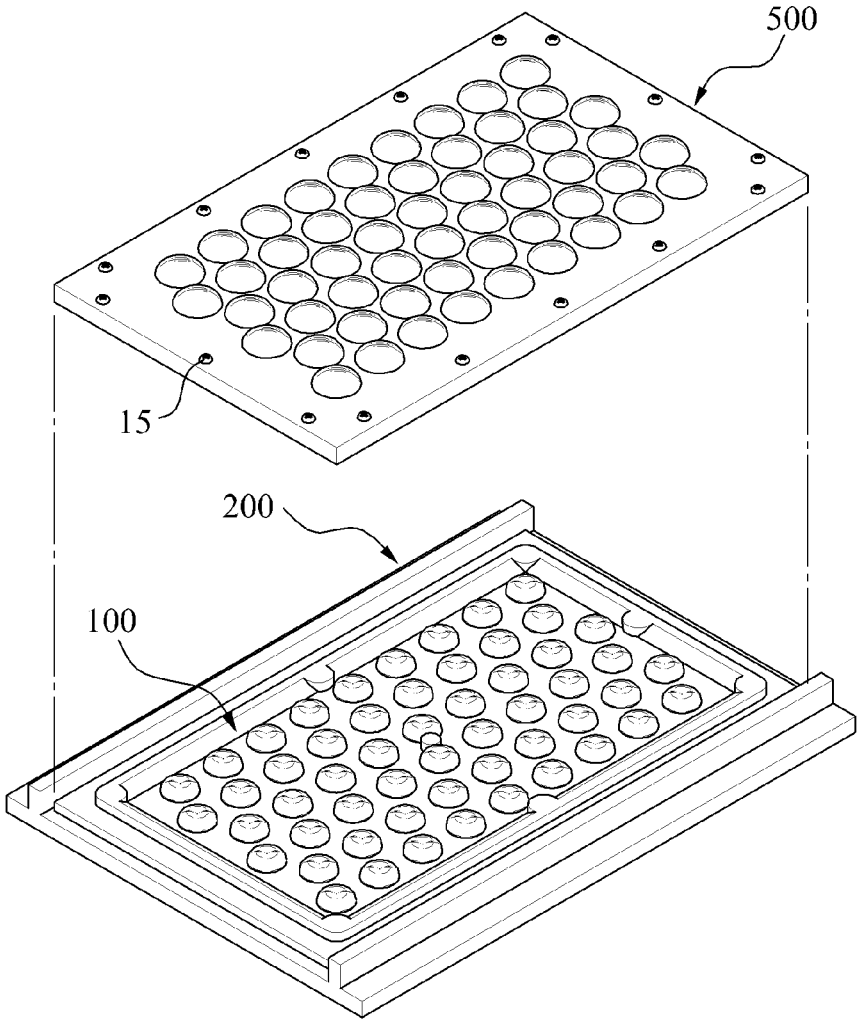
FIG. 1 illustrates a perspective view of a light emitting diode (LED) module according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

Figure 2:
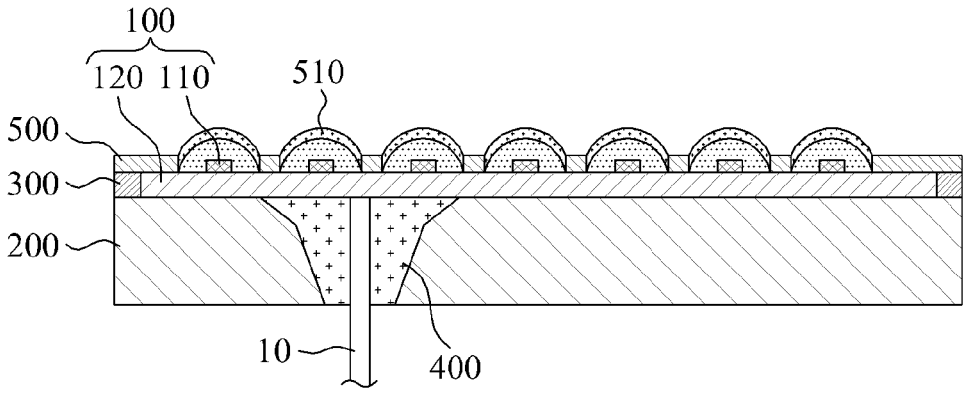
FIG. 2 illustrates a sectional view of an LED module according to example embodiments.
Figure 3:
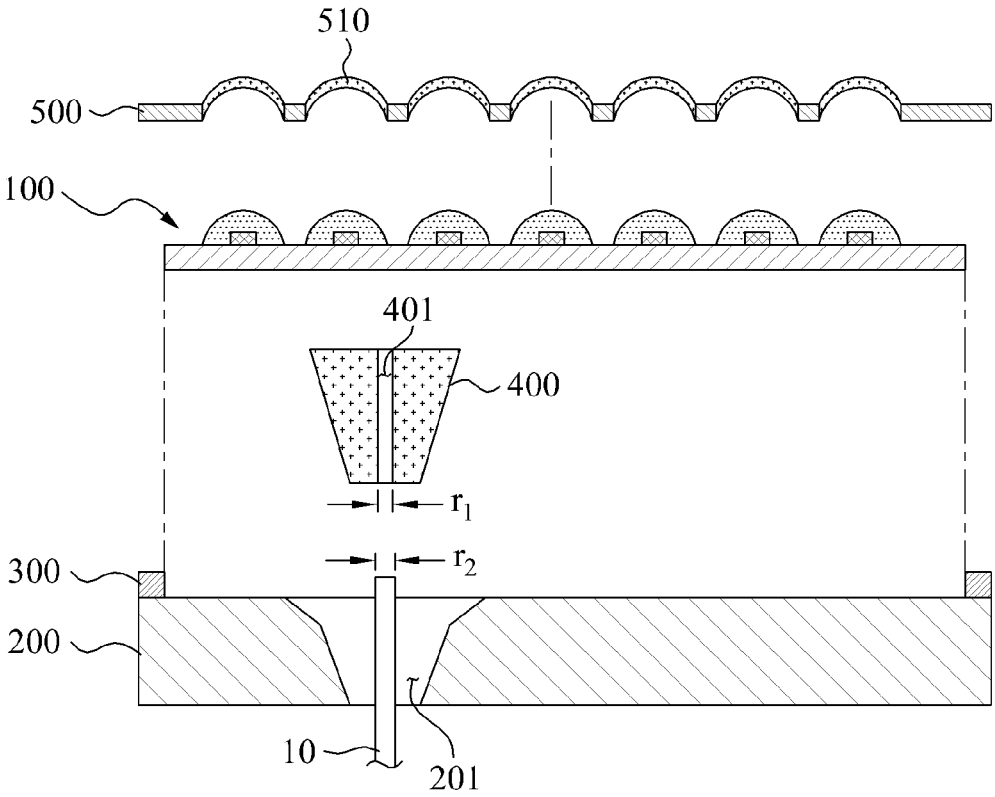
FIG. 3 illustrates an exploded sectional view of the LED module of FIG. 2.

FIG. 1 illustrates a perspective view of a light emitting diode (LED) module according to example embodiments. FIG. 2 illustrates a sectional view of an LED module according to example embodiments. FIG. 3 illustrates an exploded sectional view of the LED module of FIG. 2.

As shown in FIGS. 1 and 2, the LED module includes a substrate 100, a heat radiation unit 200, a rubber seal 300, a waterproof structure 400, and a lens plate 500.

The substrate 100 may include a circuit board 120, and an LED 110 mounted on the circuit board 120.

The lens plate 500 may include a lens 510 to guide light emitted from the LED 110 in a predetermined direction. Accordingly, the lens 510 is provided corresponding to the LED 110 in number and position.

Although the lens 510 is explained to guide the light of the LED 110 in one direction, the present invention is not limited thereto. Depending on various design conditions of the lighting device, the lens 510 may adjust intensity of the light or diffuse the light in all directions.

An electrical connection portion of the substrate 100, in other words, a structure for electrical connection between the LED 110 and the circuit board 120 may have a self waterproof function or may be disposed on a surface opposite to an LED mounting surface of the substrate 100, that is, a lower surface of the substrate 100.

A structure for supplying external power to the LED 110, that is, the structure electrically connected with a power supply cable 10 (FIG. 2) is disposed adjacent to the lower surface of the substrate 100. The power supply cable 10 will be explained later.

The heat radiation unit 200 may include an insertion hole 201 for passage of the power supply cable 10 that supplies power to the circuit board 120. The heat radiation unit 200 may have a substantially plate form made of aluminum having a high heat radiation efficiency. In addition, the heat radiation unit 200 may exemplarily have a flat plate shape to maintain the heat radiation efficiency through connection with a separate structure for heat radiation of the lighting device. However, the heat radiation unit 200 is not limited to the above structure but may have various structures and materials for radiating the heat of the LED 110.

The rubber seal 300 may be disposed between the heat radiation unit 200 and the lens plate 500, more specifically, adjacent to outer circumferences of the heat radiation unit 200 and the lens plate 500. The substrate 100 is received in an inner space defined by the heat radiation unit 200, the lens plate 500, and the rubber seal 300, thereby preventing foreign substances such as dust and moisture that may cause a disorder of the LED 110 from entering the substrate 100. The rubber seal 300 may be made of rubber although not limited thereto.

According to the present embodiment, the rubber seal 300 is disposed at the outer circumferences of the heat radiation unit 200 and the lens plate 500. However, the present invention is not limited to this embodiment. For example, a space between the heat radiation unit 200 and the lens plate 500 may be partitioned in a grid form. Also, any other configuration may be applied as long as the inner space disposed between the heat radiation unit 200 and the lens plate 500 to receive the substrate 100 is isolated from an outside, or as long as at least one predetermined portion of the substrate 100 is protected from entry of foreign substances.

The waterproof structure 400 may be inserted in the insertion hole 201. A through hole 401 for receiving the power supply cable 10 is formed in the waterproof structure 400. An inner diameter $r_1$ of the through hole 401 may be formed smaller than an outer diameter $r_2$ of the power supply cable 10 so that the through hole 401 becomes waterproof when the power supply cable 10 is inserted in the through hole 401, not to allow passage of foreign substances.

When the lens plate 500, the substrate 100, the rubber seal 300, and the heat radiation unit 200 are interconnected and the waterproof structure 400 fitted around the power supply cable 10 is inserted in the insertion hole 201 according to the above structure, the inner space defined by the lens plate 500, the rubber seal 300, and the heat radiation unit 200 forms a waterproof structure.

In addition, the heat radiation unit 200 may contact the substrate 100 as closely as possible to efficiently receive heat generated from the substrate 100.

Therefore, regardless of a structure of the lighting device mounted to the LED module, the LED module may be independently waterproof to prevent entry of moisture or substances from the outside.

Also, since the power supply cable 10 is inserted and connected in the LED module, a separate external structure, such as a cable grand, to connect the LED module with the power supply cable 10 may be omitted. Consequently, the LED module may become more compact and be easily mounted to the conventional lighting device.

Here, the insertion hole 201 may be configured to prevent the power supply cable 10 or the waterproof structure 400 from escaping to the outside. To be more specific, the insertion hole 201 may be shaped to be widened toward the inner space as shown in FIG. 2. Also, the waterproof structure 400 may be structured to be prevented from escaping and to improve the waterproof function. Accordingly, it is exemplary that the waterproof structure 400 is shaped such that a cross-section increases in an insertion direction of the power supply cable 10, that is, in the direction toward the inner space.

Figure 4:
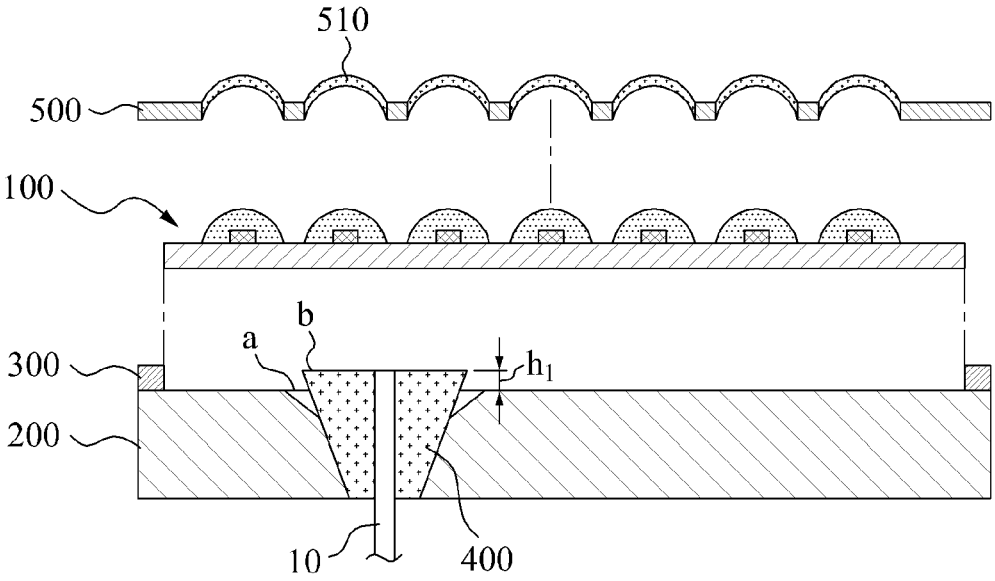
FIG. 4 illustrates a sectional view explaining a connection state of the LED module of FIG. 2.

Here, according to an exemplary embodiment, the waterproof structure 400 is protruded by a predetermined height toward the inner space and compressed by the substrate 100, thereby increasing airtight quality of the inner space as shown in FIG. 4. FIG. 4 illustrates a sectional view for explaining a connection state of the LED module of FIG. 2.

As shown in FIG. 4, the waterproof structure 400 protrudes by a height $h_1$ to the inner space. Therefore, when the circuit board 120 and the heat radiation unit 200 are connected to each other, a protruding portion of the waterproof structure 400 is compressed by the circuit board 120.

For this purpose, the waterproof structure 400 may be made of an elastic material, that is, a similar material to the rubber seal 300. The protruding height $h_1$ of the waterproof structure 400, in other words, a thickness of the protruding portion of the waterproof structure 400 may be larger than a thickness of the rubber seal 300.

An altered example of the waterproof structure 400 will be briefly explained. When the lens plate 500, the rubber seal 300, and the heat radiation unit 200 are connected by separate connection members 15 such as a bolt and a screw, the protruding portion of the waterproof structure 400 in the inner space may be deformed from an original shape b to a compressed shape a. An upper surface of the waterproof structure 400 is brought into close contact with a lower surface of the circuit board 120. As a result, a side surface of the waterproof structure 400 and the insertion hole 201 are brought into close contact with each other and the inner space is sealed by the waterproof structure 400. Thus, the waterproof integrity of the inner space is maintained.

Figure 5:
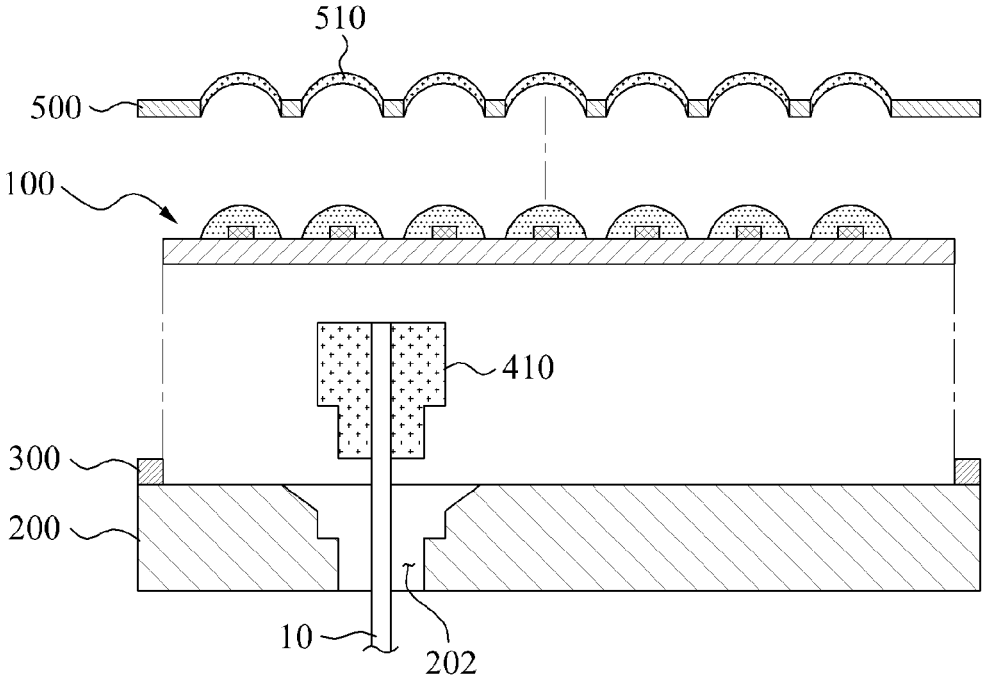
FIG. 5 illustrates a sectional view showing an altered structure of the LED module of FIG. 2.

Although the present embodiment illustrates the insertion hole 201 and the waterproof structure 400 having shapes corresponding to each other, the present invention is not limited to a specific embodiment but may be configured in many other ways as long as waterproof integrity of the inner space is maintained by compression of the waterproof structure 400. This will be described in further detail with reference to FIG. 5. FIG. 5 illustrates a sectional view showing an altered structure of the LED module of FIG. 2.

According to the drawing, the LED module includes the substrate 100, the heat radiation unit 200, the rubber seal 300, and an altered waterproof structure 410. For a concise explanation, the same or similar structures suggested in FIGS. 1 to 4 will not be explained again.

As shown in FIG. 5, the altered waterproof structure 410 is configured such that a cross-section of a portion received in the inner space is larger than a cross-section of a portion received in the heat radiation unit 200.

In other words, a longitudinal section of the altered waterproof structure 410 has a contoured step shape. That is, as a whole, the altered waterproof structure 410 is formed as if two hollow cylinders having different diameters are piled. An insertion hole 202 also has a similar shape to an outline of the altered waterproof structure 410. Alternatively, the insertion hole 202 may be configured such that a cross-section of a portion adjoining the inner space is larger than a cross-section of a portion not adjoining the inner space.

A portion of the altered waterproof structure 410, disposed adjacent to the inner space, may partly protrude into the inner space as described in the previous embodiment. The portion of the insertion hole 202, having the larger cross-section, is disposed lower than a total height of the insertion hole 202 having a shape corresponding to the altered waterproof structure 410. In addition, the insertion hole 202 is shaped to have an increasing cross-section toward the inner space to receive the compressed portion of the altered waterproof structure 410.

The insertion hole 202 may be shaped corresponding to an outline of a smaller one of the cylinders of the altered waterproof structure 410. In this case, a larger one of the cylinders of the altered waterproof structure 410 is disposed only in the inner space from the portion where the cross-section gradually increases. Accordingly, as the altered waterproof structure 410 is compressed by the circuit board 120, the inner space becomes waterproof.

Thus, it will be understood that the insertion hole 202 may have various other structures as long as a portion of the altered waterproof structure 410 fitted around the power supply cable 10 is inserted and the altered waterproof structure 410 is not separated from the heat radiation unit 200.

In addition, since the inner space of the through hole 401 is reduced by the shapes of the insertion hole 202 and the altered waterproof structure 410 and by compression by the circuit board 120, the power supply cable 10 may be prevented from escaping the through hole 401. Also, the waterproof integrity of the inner space may be maintained.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. A light emitting diode (LED) module comprising:

a substrate on which an LED is mounted;

a heat radiation unit configured to include an insertion hole for passage of a power supply cable that supplies power to the substrate, wherein the substrate is disposed on the insertion hole;

a lens plate configured to include a lens corresponding to the LED and to cover the substrate;

a rubber seal configured to be disposed between the heat radiation unit and the lens plate; and a waterproof structure configured to be inserted in the insertion hole and to include a through hole to receive the power supply cable, wherein the substrate is received in an inner space constructed as the lens plate, the rubber seal, and the heat radiation unit are connected, and the inner space has a waterproof structure.

2. The LED module of claim 1, wherein the insertion hole has a shape gradually widening toward the inner space.

3. The LED module of claim 1, wherein the waterproof structure is made of an elastic material.

4. The LED module of claim 1, wherein the waterproof structure has a shape of which a cross-section increases toward the inner space or a shape of which a portion received in the inner space has a larger cross-section than a portion received in the heat radiation unit.

5. The LED module of claim 4, wherein a portion of the waterproof structure is compressed by the substrate when the substrate is connected with the heat radiation unit.

6. The LED module of claim 1, wherein the heat radiation unit is in the form of an aluminum plate.

7. The LED module of claim 1, wherein the insertion hole has a shape of which a portion adjoining the inner space has a larger cross-section than a portion not adjoining the inner space.

* * * * *